US008388889B2

(12) United States Patent
Kawabata

(10) Patent No.: US 8,388,889 B2
(45) Date of Patent: Mar. 5, 2013

(54) HEAT-RESISTANT, AUSTENITIC CAST STEEL AND EXHAUST MEMBER MADE THEREOF

(75) Inventor: Masahide Kawabata, Moka (JP)

(73) Assignee: Hitachi Metals Ltd., Tokyo (JP)

( * ) Notice: Subject to any disclaimer, the term of this patent is extended or adjusted under 35 U.S.C. 154(b) by 0 days.

(21) Appl. No.: 12/918,782

(22) PCT Filed: Feb. 23, 2009

(86) PCT No.: PCT/JP2009/053195

§ 371 (c)(1),
(2), (4) Date: Aug. 20, 2010

(87) PCT Pub. No.: WO2009/104792

PCT Pub. Date: Aug. 27, 2009

(65) Prior Publication Data

US 2011/0000200 A1 Jan. 6, 2011

(30) Foreign Application Priority Data

Feb. 22, 2008 (JP) ..... 2008-040796

(51) Int. Cl.
*C22C 38/44* (2006.01)
*C22C 38/48* (2006.01)

(52) U.S. Cl. ..... 420/51; 420/55; 148/327

(58) Field of Classification Search ..... 148/320, 148/325–328, 336, 337; 420/8, 34–71, 87, 420/88, 94–98, 117–120, 122, 123, 124, 420/128
See application file for complete search history.

(56) References Cited

U.S. PATENT DOCUMENTS

2007/0217941 A1 9/2007 Hayashi et al.

FOREIGN PATENT DOCUMENTS

| | | | |
|---|---|---|---|
| EP | 0668367 | A1 | 8/1995 |
| JP | 7-228948 | A | 8/1995 |
| JP | 2000-204946 | A | 7/2000 |
| JP | 2000291430 | | 10/2000 |
| JP | 2002-309935 | A | 10/2002 |
| JP | 2005-320606 | A | 11/2005 |
| WO | 2005/103314 | A1 | 11/2005 |

*Primary Examiner* — Scott Kastler
*Assistant Examiner* — Vanessa Luk
(74) *Attorney, Agent, or Firm* — Sughrue Mion, PLLC

(57) ABSTRACT

Heat-resistant, austenitic cast steel comprising by mass 0.3-0.6% of C, 1.1-2% of Si, 1.5% or less of Mn, 17.5-22.5% of Cr, 8-13% of Ni, 1.5-4% as (W+2Mo) of at least one of W and Mo, 1-4% of Nb, 0.01-0.3% of N, 0.01-0.5% of S, the balance being Fe and inevitable impurities, and meeting the following formulae (1), (2), (3) and (4):

$$0.05 \leqq (C - Nb/8) \leqq 0.6 \quad (1),$$

$$17.5 \leqq 17.5Si - (W+2Mo) \quad (2),$$

$$5.6Si + (W+2Mo) \leqq 13.7 \quad (3), \text{ and}$$

$$0.08Si + (C - Nb/8) + 0.015Cr + 0.011Ni + 0.03W + 0.02Mo < 0.96 \quad (4),$$

wherein the symbol of each element corresponds to the amount (% by mass) of each element in the cast steel.

4 Claims, 1 Drawing Sheet

HEAT-RESISTANT, AUSTENITIC CAST STEEL AND EXHAUST MEMBER MADE THEREOF

FIELD OF THE INVENTION

The present invention relates to heat-resistant cast steel suitable for exhaust members, etc. for gasoline engines and diesel engines of automobiles, particularly to heat-resistant, austenitic cast steel having excellent heat resistance such as oxidation resistance, thermal fatigue life, etc. as well as excellent weldability, and an exhaust member made thereof.

BACKGROUND OF THE INVENTION

Recently, strong demand for the reduction of environmental load and environmental protection on a global scale urges automobiles to discharge cleaner exhaust gases to reduce the amounts of air-polluting materials, to save energy, and to improve fuel efficiency to reduce the amount of $CO_2$ discharged, which is one of causes for global warming Developed and adopted for the cleaning of exhaust gases from automobiles and improving fuel efficiency are various technologies, such as engines with higher performance and fuel efficiency, post treatments for removing air-polluting materials discharged from engines, the weight reduction of automobile bodies, the reduction of aerodynamic resistance of automobile bodies, low-loss power transmission from engines to driven systems, etc.

Among them, technologies for providing engines with higher performance and fuel efficiency include direct fuel injection, high-pressure fuel injection, an increased compression ratio, higher boosting pressure of turbochargers, reduced displacement, the weight and size reduction of engines by turbo-charging, etc., and these technologies are applied not only to luxury cars but also to popular cars. As a result, combustion tends to occur in engines at higher temperature and pressure, so that combustion chambers of engines discharge a higher-temperature exhaust gas to exhaust members. For instance, even popular cars have as high exhaust gas temperatures as 1000° C. or higher like luxury sport cars, resulting in exhaust members having surface temperatures of higher than 950° C. Exhaust members are put in a severer oxidation environment than ever, being exposed to oxidizing gases and oxygen in the air in such a high temperature region. Exhaust members are also repeatedly subjected to cycles of heating and cooling by the start and stop of engines. Thus, exhaust members are required to have higher heat resistance and durability such as oxidation resistance, thermal fatigue life, etc. than desired conventionally.

Because exhaust members such as exhaust manifolds, turbine housings, etc. for gasoline engines and diesel engines of automobiles have complicated shapes, they have conventionally been produced by casting with high degree of design freedom. In addition, because they are used in severe conditions at high temperatures, heat-resistant cast iron such as high-Si, spheroidal graphite cast iron and Ni-Resist cast iron (austenitic, cast Ni—Cr iron), heat-resistant, ferritic cast steel, heat-resistant, austenitic cast steel, etc. having excellent heat resistance and oxidation resistance are used.

Although conventional heat-resistant cast irons such as high-Si, spheroidal graphite cast iron and Ni-Resist cast iron have relatively high strength at exhaust gas temperatures of 900° C. or lower and at exhaust member temperatures of about 850° C. or lower, they have lower strength and heat resistance such as oxidation resistance and thermal fatigue life, when exposed to an exhaust gas environment exceeding 900° C. Further because Ni-Resist cast iron contains about 35% by mass of Ni, a rare metal, it is expensive. The heat-resistant, ferritic cast steel usually has poor high-temperature strength at 900° C. or higher.

The heat-resistant, austenitic cast steel is more durable to high temperatures than the heat-resistant cast iron and the heat-resistant, ferritic cast steel. JP 7-228948 A discloses heat-resistant, austenitic cast steel suitable for exhaust members, etc. of automobile engines, which comprises by mass 0.2-1.0% of C, 0.05-0.6% of (C—Nb/8), 2% or less of Si, 2% or less of Mn, 15-30% of Cr, 8-20% of Ni, 1-6% of W, 0.5-6% of Nb, 0.01-0.3% of N, 0.01-0.5% of S, the balance being Fe and inevitable impurities. JP 7-228948 A describes that heat-resistant cast steel obtained by adding proper amounts of Nb, W, N and S to 20Cr-10Ni-based, heat-resistant, austenitic cast steel has improved high-temperature strength at 900° C. or higher, as well as excellent castability and machinability, suitable for exhaust members.

However, because the 20Cr-10Ni, heat-resistant, austenitic cast steel described in JP 7-228948 A was proposed to be used at exhaust member temperatures of about 900-950° C., it has poor heat resistance and durability, and insufficient oxidation resistance and thermal fatigue life, at temperatures of about 1000° C. Particularly its thermal fatigue life is unsatisfactory, leaving room for improvement. Accordingly, it cannot be used for exhaust members (for instance, turbine housings for turbochargers operable at high boosting pressure), whose surface temperatures reach about 1000° C.

As an exhaust member made of heat-resistant, austenitic cast steel having improved durability in high-temperature use conditions, JP 2000-291430 A discloses an exhaust member made of heat-resistant, high-Cr, high-Ni, austenitic cast steel having a composition comprising by mass 0.2-1.0% of C, 2% or less of Si, 2% or less of Mn, 0.04% or less of P, 0.05-0.25% of S, 20-30% of Cr, and 16-30% of Ni, the balance being Fe and inevitable impurities, and further comprising 1-4% of W, and/or more than 1% and 4% or less of Nb, a mass ratio of Cr/Ni being 1.0-1.5. The heat-resistant, high-Cr, high-Ni, austenitic cast steel described in JP 2000-291430 A is cast steel obtained by controlling the composition range and structure based on 25Cr-20Ni, heat-resistant, austenitic cast steel with increased amounts of Cr and Ni as main alloy elements, rather than on the 20Cr-10Ni, heat-resistant, austenitic cast steel to have drastically improved high-temperature strength and oxidation resistance, such that it can be suitably used for exhaust members exposed to exhaust gases exceeding 1000° C. (particularly about 1050° C., further about 1100° C.).

However, the 25Cr-20Ni, heat-resistant, austenitic cast steel described in JP 2000-291430 A contains large amounts of Cr and Ni, expensive rare metals, to have high-temperature properties and heat resistance. Because these rare metals are produced in small amounts only in limited countries and regions, they are not only expensive but also easily influenced by global economic conditions, resulting in unstable supply, high price by speculation, etc. Because the 25Cr-20Ni, heat-resistant, austenitic cast steel described in JP 2000-291430 A contains about 25% by mass of Cr and about 20% by mass of Ni, it suffers high production cost, economically disadvantageous for use in exhaust members of engines for popular cars, and fails to secure stabile supply.

To clean exhaust gases from automobiles and improve fuel efficiency, exhaust members should be improved in various points in addition to the above heat resistance and durability. For instance, in a post-treatment of cleaning exhaust gases (a treatment for removing harmful materials, etc. from the exhaust gas by a catalyst and a filter in an exhaust-gas-cleaning apparatus), it is necessary to improve cleaning performance by quickly activating the catalyst by temperature elevation when the engine is started, and by supplying an exhaust gas uniformly to the entire catalyst and filter. For quick activation of the catalyst, an exhaust gas passing through the exhaust member should be subjected to little temperature decrease, namely, the energy of the exhaust gas should be kept as much as possible. Accordingly, exhaust paths should have small thermal capacity (heat mass), requiring that the exhaust member is as thin as possible. To improve the cleaning performance of a catalyst, etc., to prevent engine power from lowering, and to improve the efficiency of turbochargers, etc., the exhaust gas should flow smoothly with little pressure loss. To this end, it is effective to provide the exhaust gas with reduced flow resistance, improved distribution, less turbulence and interference, etc. For instance, the design of an exhaust member should take into consideration the shortening of exhaust paths, the prevention of rapid direction changes, etc.

Automobile bodies are required to have a reduced weight and low aerodynamic resistance for higher fuel efficiency, and improved safety. For instance, a body has a low bonnet immediately above an engine room for improved aerodynamics, an impact-absorbing (crushable) zone in the engine room for safety at car crash, etc. These measures have decreased the freedom of layout design in the engine room, requiring that the exhaust member has reduced weight and volume. Thus, to make automobiles lighter and safer, weight and size reduction, smooth discharge, etc. are necessary to exhaust members.

To meet the above requirements for exhaust members, proposals have been made to provide, for instance, (a) a thin, light-weight exhaust manifold having exhaust paths with small thermal capacity, which comprises exhaust path members that are branch pipes formed by thin metal plates or pipes, and cast members including flanges fixed to a cylinder head, a turbine housing, etc. and a converging case, both members being welded to each other, (b) a long exhaust manifold comprising pluralities of cast members welded via corrugated pipe members for preventing cracking due to thermal expansion, (c) a light-weight, small-size exhaust member comprising a cast exhaust manifold and a cast turbine housing, which are welded instead of usual fastening with bolts to make thick flanges for fastening bolts and space for inserting a bolt-fastening tool unnecessary, thereby reducing thermal capacity, etc.

As described above, to achieve high heat resistance and durability, as well as thinning, weight and size reduction, smooth discharge, etc. necessary for exhaust members, it is effective to weld plate or pipe metal members with cast members, or cast members themselves. With respect to exhaust members that tend to have complicated shapes, cast members with high freedom of shape are contained and welded to improve their freedom of design and ease of production, thereby omitting parts such as fastening bolts, gaskets, etc.

Necessary for welded exhaust members is sufficient weldability to avoid weld cracking. The weldability is an important property not only for welding members but also for repairing defective cast members by welding, affecting their production yield and productivity. Thus, materials for exhaust members are required to have weldability in addition to heat resistance and durability. With respect to the heat-resistant, austenitic cast steel, JP 7-228948 A and JP 2000-291430 A do not provide enough investigation as to the improvement of weldability in addition to heat resistance and durability, taking economic feasibility into consideration.

OBJECT OF THE INVENTION

Accordingly, an object of the present invention is to provide heat-resistant, austenitic cast steel having excellent heat resistance such as oxidation resistance and thermal fatigue life at around 1000° C., and excellent weldability, and containing small amounts of rare metals to exhibit economic advantages in the effective use and stable supply of natural resources, etc., and an exhaust member made of this heat-resistant, austenitic cast steel suitable for automobile engines.

DISCLOSURE OF THE INVENTION

In view of the fact that the 20Cr-10Ni alloy described in JP 7-228948 A has poor heat resistance and durability at about 1000° C. despite relatively small amounts of Cr and Ni contained as rare metals, while the 25Cr-20Ni alloy described in JP 2000-291430 A contains large amounts of Cr and Ni despite excellent heat resistance and durability at higher than 1000° C., the inventor has made investigation as to whether the same heat resistance and durability at about 1000° C. as those of the 25Cr-20Ni alloy can be obtained with alloy elements and composition ranges changed, even when the amounts of Cr and Ni contributing to heat resistance and durability are reduced in the 20Cr-10Ni, heat-resistant, austenitic cast steel.

As a result, it has been found that though an increased amount of Si would provide the 20Cr-10Ni alloy containing small amounts of Cr and Ni with the same heat resistance as that of the 25Cr-20Ni alloy, a large amount of Si would extremely deteriorate the weldability of the alloy. As a result of further investigation to discover a composition range with increased Si that gives heat resistance and durability without deteriorating weldability, the inventor has found that (a) to have essential heat resistance such as high-temperature strength, oxidation resistance, etc., Si should be increased, while limiting the amount of each main alloy element such as C, Mn, Cr, Ni, W, Mo, Nb, N and S, etc. in a proper range, that (b) to improve thermal fatigue life, a particular relation should be met between Si and W and/or Mo, and that (c) to have good weldability with an increased amount of Si, not only the amount of each of C, Si, Cr, Ni, W, Mo and Nb but also their total amount should be restricted to meet particular relations. The present invention has thus been completed based on such discovery.

Thus, the heat-resistant, austenitic cast steel of the present invention comprises by mass 0.3-0.6% of C, 1.1-2% of Si, 1.5% or less of Mn, 17.5-22.5% of Cr, 8-13% of Ni, 1.5-4% as (W+2Mo) of at least one of W and Mo, 1-4% of Nb, 0.01-0.3% of N, 0.01-0.5% of S, the balance being Fe and inevitable impurities, and meeting the following formulae (1), (2), (3) and (4):

$$0.05 \leqq (C—Nb/8) \leqq 0.6 \quad (1),$$

$$17.5 \leqq 17.5Si-(W+2Mo) \quad (2),$$

$$5.6Si+(W+2Mo) \leqq 13.7 \quad (3), \text{ and}$$

$$0.08Si+(C—Nb/8)+0.015Cr+0.011Ni+0.03W+0.02Mo \leqq 0.96 \quad (4),$$

wherein the symbol of each element corresponds to the amount (% by mass) of each element in the cast steel.

The heat-resistant, austenitic cast steel of the present invention preferably has weight loss by oxidation of 20 mg/cm$^2$ or less when kept at 1000° C. for 200 hours in the air.

The heat-resistant, austenitic cast steel of the present invention preferably has a thermal fatigue life of 800 cycles or more, when measured by a thermal fatigue test comprising heating and cooling under the conditions of a heating temperature upper limit of 1000° C., a temperature amplitude of 850° C. or more, and a constraint ratio of 0.25.

The exhaust member of the present invention is made of the above heat-resistant, austenitic cast steel. This exhaust member is preferably an exhaust manifold, a turbine housing, a turbine housing integral with an exhaust manifold, a catalyst case, a catalyst case integral with an exhaust manifold, or an exhaust outlet.

DESCRIPTION OF THE BEST MODE OF THE INVENTION

[1] Heat-resistant, Austenitic Cast Steel

Figure 1:
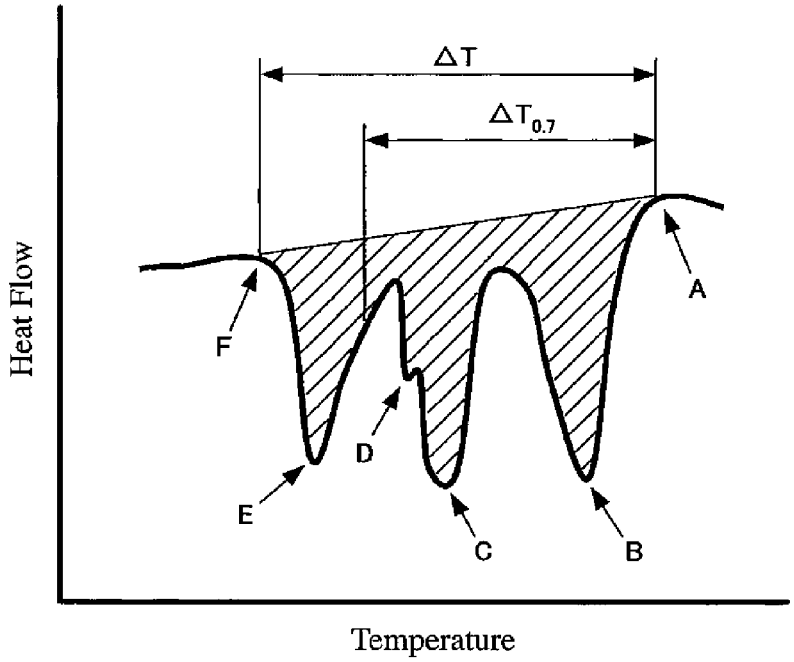
FIG. 1 is a graph schematically showing the thermal analysis results of heat-resistant, austenitic cast steel by differential scanning calorimetry (DSC).

The heat-resistant, austenitic cast steel of the present invention will be explained in detail below. The amount of each element constituting the alloy is expressed by "% by mass" unless otherwise mentioned.

(1) C (Carbon): 0.3-0.6%

C has functions of (a) improving the flowability (castability) of a melt, (b) being partially dissolved in the matrix for solid solution strengthening, (c) forming crystallized or precipitated Cr carbides to increase high-temperature strength, and (d) forming eutectic carbides with Nb to improve castability and high-temperature strength. To exhibit such functions effectively, the amount of C should be 0.3% or more. However, when C exceeds 0.6%, too much Cr carbides are crystallized or precipitated, resulting in a brittle alloy with low ductility and machinability. In addition, too much crystallized Cr carbides provide the alloy with low weldability. Accordingly, the amount of C is restricted to 0.3-0.6%. The preferred amount of C is 0.4-0.55%.

(2) Si (Silicon): 1.1-2%

Si is an element functioning as a deoxidizer for the melt and effective for improving oxidation resistance and a thermal fatigue life. The oxidation resistance is closely related to the composition of a surface oxide layer of a casting. With respect to a surface oxide layer of the 20Cr-10Ni, heat-resistant, cast steel of the present invention heated to about 1000° C., a small amount of Si causes an Fe-rich oxide layer to rapidly grow in the outermost layer, resulting in poor oxidation resistance, but a large amount of Si forms a Cr oxide layer in the outermost layer and a blocky Si oxide phase inside the outermost layer. The oxide layers of Cr and Si grow slowly, showing good oxidation resistance. To form a Cr oxide layer in the outermost layer and a Si oxide phase inside the outermost layer, 1.1% or more of Si is necessary. However, excess Si results in an unstable austenitic structure and poor castability. Though increase in Si to some extent improves weldability, excess Si deteriorates weldability extremely, causing weld cracking easily. Thus, the amount of Si is 2% or less. Accordingly, the amount of Si is limited to 1.1-2%. The amount of Si is preferably 1.25-1.8%, more preferably 1.3-1.6%.

(3) Mn (Manganese): 1.5% or Less

Mn is effective as a deoxidizer for the melt like Si, but excess Mn deteriorates oxidation resistance. Thus, the amount of Mn is 1.5% or less.

(4) Cr (Chromium): 17.5-22.5%

Cr is an extremely important element of austenitizing the structure of the heat-resistant cast steel with Ni described below to improve its high-temperature strength and oxidation resistance, and forming crystallized or precipitated carbides to improve the high-temperature strength. To exhibit these effects particularly at as high temperatures as about 1000° C., Cr should be 17.5% or more. However, when Cr exceeds 22.5%, ferrite is crystallized in the structure. Though about several percentages of crystallized ferrite suppress weld cracking to improve weldability, increased ferrite results in the decreased high-temperature strength. Also, excess Cr provides too much crystallized carbides, making the cast steel brittle and thus have low ductility. Further, excess Cr should not be contained from the economic point of view, because it is one of rare metals. Accordingly, the amount of Cr is 17.5-22.5%.

(5) Ni (Nickel): 8-13%

Ni is an element effective for providing the heat-resistant cast steel with an austenitic structure with Cr described above, thereby stabilizing the structure, and generally increasing the castability of thin exhaust members with complicated shapes. To exhibit such functions, Ni should be 8% or more. However, because Ni is one of rare metals like Cr, excess Ni should not be contained from the economic point of view such as cost saving, the effective use and stable supply of natural resources, etc. Because the heat-resistant, austenitic cast steel of the present invention containing 1.1% or more of Si has the same heat resistance as that of the 25Cr-20Ni, heat-resistant, austenitic cast steel at about 1000° C., the amount of Ni can be limited to 13% or less. Accordingly, the amount of Ni is 8-13%. The preferred amount of Ni is 9-12%.

(6) At Least One of W (Tungsten) and Mo (Molybdenum): 1.5-4% as (W+2Mo)

Both W and Mo improve the high-temperature strength of the heat-resistant cast steel. This effect is obtained by at least one of them, but the addition of both elements in large amounts deteriorates oxidation resistance. Accordingly, when W is added alone, the amount of W is 1.5-4%, preferably 2-3.5%. Because Mo has substantially the same effects as those of W at a mass ratio of W=2Mo, part or all of W may be substituted by Mo. When Mo is added alone, the amount of Mo is 0.75-2%, preferably 1-1.75%. When both elements are added, (W+2Mo) is 1.5-4%, preferably 2-3.5%.

(7) Nb (Niobium): 1-4%

Nb is combined with C to form fine carbides, improving the high-temperature strength and thermal fatigue life of the heat-resistant cast steel. It also suppresses the formation of crystallized Cr carbides to improve oxidation resistance and machinability. Because Nb forms eutectic carbides, it improves castability important for the production of thin castings having complicated shapes, such as exhaust members. For such purpose, the amount of Nb should be 1% or more. However, excess Nb forms many eutectic carbides in crystal grain boundaries, providing the cast steel with brittleness and extremely reduced strength and ductility. Accordingly, the amount of Nb is 1-4%.

(8) N (Nitrogen): 0.01-0.3%

N is a strong austenite-forming element, providing the heat-resistant cast steel with a stable austenite matrix and improved high-temperature strength. However, excess N lowers impact value at around room temperature, and enhances the generation of gas defects such as pinholes, blowholes, etc. during casting, lowering a casting yield. Accordingly, the amount of N is 0.01-0.3%.

(9) S (Sulfur): 0.01-0.5%

S forms spherical or granular sulfides in the cast steel, which improves machinability because of its lubricating function. To this effect, S should be 0.01% or more. However, when more than 0.5% of S is contained, the impact value is lowered at around room temperature. Accordingly, the amount of S is 0.01-0.5%. The preferred amount of S is 0.05-0.2%.

(10) Inevitable Impurities

A main inevitable impurity in the heat-resistant, austenitic cast steel of the present invention is P coming from raw materials. Because P is segregated in crystal grain boundaries to extremely lower toughness, its amount is preferably as small as possible, desirably 0.04% or less.

The amounts of basic components are explained above, but it is insufficient in the present invention that alloy elements merely meet the above composition requirements, and the relations expressed by the following formulae (1), (2), (3) and (4) should be met. The symbols of elements in the formulae (1) -(4) express the amounts (% by mass) of elements in the heat-resistant cast steel.

(11) Formula (1): $0.05 \leqq (C—Nb/8) \leqq 0.6$

The heat-resistant, austenitic cast steel of the present invention has high castability by eutectic Nb carbides, and high strength by proper amounts of precipitated carbides. Eutectic carbide (NbC) is formed by Nb and C at a mass ratio of 8/1. To form proper amounts of precipitated carbides in addition to the eutectic carbide (NbC), C should be in an amount exceeding that consumed by the formation of the eutectic carbide. To obtain excellent castability and high-temperature strength, (C—Nb/8) in the formula (1) should be 0.05 or more. However, when (C—Nb/8) exceeds 0.6, excess carbides are formed, resulting in hard, brittle cast steel with reduced ductility and machinability. Accordingly, (C—Nb/8) in the formula (1) should be 0.05-0.6. Particularly in thin castings needing high castability, the amount of the eutectic carbide is important. The preferred range of (C—Nb/8) is 0.1-0.3 in the formula (1).

(12) Formula (2): $17.5 \leqq 17.5Si-(W+2Mo)$, and Formula (3): $5.6Si+(W+2Mo) \leqq 13.7$ As described above, the inventor has found that in the heat-resistant, austenitic cast steel of the present invention, percentage relations between Si and W and/or Mo affect the thermal fatigue life. The heat-resistant, austenitic cast steel of the present invention has good oxidation resistance because of an increased amount of Si, but it has been found that in a basic composition range of the present invention containing a small or large amount of Si, increase in the amounts of W and/or Mo deteriorates thermal fatigue life though the oxidation resistance is not largely affected. Namely, in the basic composition range of the present invention, decrease in Si with W and/or Mo increased increases the percentage of precipitated carbides in the austenite matrix, while increase in Si with W and/or Mo increased forms ferrite with poor high-temperature strength. Because increase in precipitated carbides in the austenite matrix lowers ductility, and because the formation of ferrite with poor high-temperature strength concentrates stress in a low-strength phase in the matrix, both deteriorates the thermal fatigue life.

To obtain the heat-resistant, austenitic cast steel of the present invention having excellent thermal fatigue life, it is necessary not only to limit the amounts of Si, and W and/or Mo separately, but also to regulate the relation between Si and (W+2Mo), both W and Mo having similar effects. The formulae (2) and (3) are derived from the investigation of the relation between the amounts of Si and W and/or Mo and the thermal fatigue life based on the above finding, and both formulae (2) and (3) should be met to secure a long thermal fatigue life. The formula (2) of $17.5 \leqq 17.5Si-(W+2Mo)$ is a condition necessary for suppressing increase in precipitated carbides in the austenite matrix, and the formula (3) of $5.6Si+(W+2Mo) \leqq 13.7$ is a condition necessary for suppressing the formation of ferrite with poor high-temperature strength. To obtain improved thermal fatigue life, heat resistance and durability, the formulae (2) and (3) should be met. The left-side value in the formula (3) is preferably 12.7 or less.

(13) Formula (4): $0.08Si+(C—Nb/8)+0.015Cr+0.011Ni+0.03W+0.02Mo \leqq 0.96$

Mere increase in the amount of Si in the 20Cr-10Ni-based, heat-resistant, austenitic cast steel of the present invention to improve heat resistance results in poor weldability. The inventor has found that the total amount of C, Si, Cr, Ni, W, Mo and Nb affects the weldability, achieving the component parameters of C, Si, Cr, Ni, W, Mo and Nb defined by the above formula (4) for avoiding the deterioration of weldability. The formula (4) is a condition necessary for securing the weldability even at an increased percentage of Si, and meeting the formula (4) reduces a solidification temperature range, effectively suppressing the weld cracking.

In steel, susceptibility to the weld cracking is generally correlated with a solidification temperature range $\Delta T$ from the solidification start to the solidification end, the smaller the $\Delta T$ is, the less weld cracking occurs. The inventor's investigation including thermal analysis has revealed that in the heat-resistant, austenitic cast steel of the present invention, susceptibility to the weld cracking is correlated with a solidification temperature range $\Delta T_{0.7}$ from the solidification start to about 70% of solidification, rather than $\Delta T$, the smaller the $\Delta T_{0.7}$ is, the less weld cracking occurs.

FIG. 1 schematically shows the thermal analysis results of the solidification process of heat-resistant, austenitic cast steel by differential scanning calorimetry (DSC). In the heat-resistant cast steel of the present invention, the solidification starts at a point A, austenite is first crystallized (point B), a eutectic phase of Nb carbide (NbC) and austenite is then crystallized (point C), MnS is crystallized at the end of crystallization of the eutectic phase of Nb carbide and austenite (point D), a eutectic phase of Cr carbide and austenite is crystallized (point E), and the solidification ends at point F. In FIG. 1, $\Delta T$ is a temperature range from the solidification start (point A) to the point F at which the solidification completely ends, and $\Delta T_{0.7}$ is a temperature range from the solidification start (point A) to 70% of the solidification. A thermal analysis curve showing the relation between temperature and heat flow is image-analyzed to obtain a hatched area in FIG. 1, and a heat flow area is successively accumulated by a unit temperature from the solidification start (point A) to determine a temperature at which the accumulated area reaches 70% of the total hatched area (100%) as a temperature at which 70% of the solidification ends.

The inventor's investigation of the relation between thermal analysis results of heat-resistant cast steels having various compositions and weld cracking has revealed that heat-resistant cast steel with a small heat flow in a peak (valley) at a point E in FIG. 1 suffers little weld cracking, and the comparison of several heat-resistant cast steels with different compositions, substantially the same $\Delta T$ and different heat flows in the peak at a point E has revealed that heat-resistant cast steels with smaller heat flows have smaller solidification temperature ranges $\Delta T_{0.7}$, suffering little weld cracking.

Weld cracking generally occurs by thermal stress applied to a liquid phase remaining in the final phase of solidification. A smaller solidification temperature range causes solidification to quickly proceed after the solidification start, resulting in the decreased amount of the remaining liquid phase, thereby reducing the weld cracking because the solidification is completed before cracking under thermal stress. Rapid solidification accelerates the generation of large numbers of solidification nuclei, while suppressing the growth of the generated solidification nuclei to make the solidified structure finer, thereby improving the strength, and preventing low-melting-point impurities such as P from segregating in crystal grain boundaries to avoid decrease in the ductility of the grain boundaries. These functions appear to suppress the weld cracking. The influence of the amount of the remaining liquid phase, etc. on the weld cracking depends on the composition of cast steel, and what is affected by the composition is not the solidification temperature range $\Delta T$ until the last liquid phase disappears to complete solidification, but the solidification temperature range $\Delta T_{0.7}$ from the solidification start to 70% of the solidification. It is thus presumed that with substantially the same $\Delta T$, weld cracking is less likely to occur at smaller $\Delta T_{0.7}$.

As described above, small heat flow at a peak point E in FIG. 1 provides small $\Delta T_{0.7}$. The heat flow changes at the point E, at which a eutectic phase of Cr carbide and austenite is crystallized in a final phase of the solidification. Accordingly, decrease in the amount of a eutectic crystal of Cr carbide and austenite would reduce heat flow at the peak point E, resulting in reduced $\Delta T_{0.7}$.

The inventor's further investigation of the amounts of basic components to improve the weldability based on this knowledge has led to the finding of component parameters for controlling the amount of a eutectic crystal of Cr carbide and austenite. With the amounts of Si, Cr, Ni, W and Mo controlled to reduce (C—Nb/8) in the above formula (1), the amount of a eutectic crystal of Cr carbide and austenite generated in a final phase of the solidification is reduced, resulting in low heat flow at the peak point E in FIG. 1 and small $\Delta T_{0.7}$, and thus making the cast steel less susceptible to the weld cracking.

The formula (4) expresses component parameters for controlling the crystallization of a eutectic phase of Cr carbide and austenite to reduce susceptibility to the weld cracking to improve the weldability, which are found from the above investigation. Specifically, when the value of the formula (4) determined by the amounts of C, Si, Cr, Ni, W, Mo and Nb is 0.96 or less, the heat-resistant, austenitic cast steel is less susceptible to weld cracking, having good weldability even at an increased amount of Si. If the value of the formula (4) exceeds 0.96, there is too much a eutectic crystal of Cr carbide and austenite even when the amount of each element is within the above range of the present invention, resulting in high heat flow at the peak point E and thus large $\Delta T_{0.7}$, inviting the weld cracking. Accordingly, the present invention limits the value of the formula (4) to 0.96 or less in addition to the above limitation of the amounts of C, Si, Cr, Ni, W, Mo and Nb to obtain the improved weldability.

Investigation of the relation between the solidification temperature range $\Delta T_{0.7}$, the value of the formula (4), and the generation of weld cracking has revealed that in the composition range of the present invention, the value of the formula (4) of 0.96 or less provides $\Delta T_{0.7}$ of 70° C. or lower, resulting in no weld cracking, while the value of the formula (4) exceeding 0.96 provides $\Delta T_{0.7}$ exceeding 70° C., resulting in weld cracking.

As far as the weldability is concerned, the fact that solidification has no point E in FIG. 1 would make both $\Delta T_{0.7}$ and $\Delta T$ small, drastically improving weldability. What is needed to avoid the point E is to restrict the amounts of related alloy elements such that the value of the formula (4) is as small as possible, to prevent a eutectic phase of Cr carbide and austenite from being crystallized. However, if the crystallization of the eutectic phase of Cr carbide and austenite were extremely reduced, the heat-resistant, austenitic cast steel of the present invention would have poor high-temperature strength and oxidation resistance, failing to secure inherent properties of heat resistance and durability. Accordingly, the lower limit of the value of the formula (4) is restricted depending on the amounts of Si, Cr, Ni, W and Mo, and (C—Nb/8).

Thus, with not only the amount of each of C, Si, Cr, Ni, W, Mo and Nb, but also their total amount limited within the range of the formula (4), the amount of a crystallized eutectic phase of Cr carbide and austenite is reduced, resulting in the decreased solidification temperature range $\Delta T_{0.7}$. As a result, solidification rapidly proceeds after the solidification start, resulting in drastically reduced susceptibility to the weld cracking.

[2] Properties

(14) Weight Loss by Oxidation: 20 mg/cm$^2$ or Less

The weight loss by oxidation of the heat-resistant, austenitic cast steel of the present invention is preferably 20 mg/cm$^2$ or less when kept in the air at 1000° C. for 200 hours. Exhaust members made of the heat-resistant, austenitic cast steel are exposed to a high-temperature exhaust gas from engines, which contains oxide gases such as sulfur oxides, nitrogen oxides, etc., resulting in oxide films formed on the member surfaces. Further oxidation generates cracks starting from the oxide films, permitting oxidation to proceed inside the members. Cracks finally penetrate the members from front surfaces to rear surfaces, causing the leak of an exhaust gas and the cracking of the members.

When the heat-resistant, austenitic cast steel is used for exhaust members exposed to an exhaust gas at a temperature exceeding 1000° C., the surface temperatures of the exhaust members reach nearly 950-1000° C. When the weight loss by oxidation when kept in air at 1000° C. for 200 hours exceeds 20 mg/cm$^2$, more crack-starting oxide films are formed, resulting in insufficient oxidation resistance. When the weight loss by oxidation is 20 mg/cm$^2$ or less under this condition, the formation of oxide films and the generation of cracks are suppressed, resulting in heat-resistant, austenitic cast steel with excellent oxidation resistance, high heat resistance and durability, and long life. The weight loss by oxidation of the heat-resistant, austenitic cast steel of the present invention is more preferably 15 mg/cm$^2$ or less, most preferably 10 mg/cm$^2$ or less.

(15) Thermal Fatigue Life: 800 Cycles or More

The heat-resistant, austenitic cast steel of the present invention preferably has a thermal fatigue life of 800 cycles or more, which is measured by a thermal fatigue test comprising heating and cooling under the conditions of a heating temperature upper limit of 1000° C., a temperature amplitude of 850° C. or more, and a constraint ratio of 0.25. Exhaust members are required to have long thermal fatigue lives to the repetition of start (heating) and stop (cooling) of engines. The thermal fatigue life is one of indices indicating the heat resistance and durability. More cycles until cracks and deformation generated by the repeated heating and cooling in a thermal fatigue test cause thermal fatigue failure indicate a longer thermal fatigue life, meaning excellent heat resistance and durability.

The thermal fatigue life can be evaluated, for instance, by repeating cycles of heating and cooling to a smooth, round rod test piece of 25 mm in gauge length and 10 mm in diameter in the air under the conditions that the upper limit of a heating temperature is 1000° C., that the lower limit of a cooling temperature is 150° C., and that the temperature amplitude is 850° C. or more, one cycle comprising 2 minutes of heating, 1 minute of temperature keeping and 4 minutes of cooling, 7 minutes in total, with elongation and shrinkage due to heating and cooling mechanically constrained to cause thermal fatigue failure. The thermal fatigue life is evaluated by the number of cycles when the maximum tensile load measured by each cycle has decreased to 75%, with the maximum tensile load (generated at the lower limit of a cooling temperature) of the second cycle as a reference (100%) in a load-temperature diagram obtained from load change due to the repetition of heating and cooling. The degree of mechanical constraint is expressed by a constraint ratio defined by (elongation by free thermal expansion−elongation under mechanical constraint)/(elongation by free thermal expansion). For instance, the constraint ratio of 1.0 is a mechanical constraint condition in which no elongation is permitted to a test piece heated, for instance, from 150° C. to 1000° C. The constraint ratio of 0.5 is a mechanical constraint condition in which, for instance, only 1-mm elongation is permitted when the elongation by free thermal expansion is 2 mm. Accordingly, at a constraint ratio of 0.5, a compression load is applied during temperature elevation, while a tensile load is applied during temperature decrease. The thermal fatigue life of the heat-resistant, austenitic cast steel of the present invention is evaluated at a constraint ratio of 0.25, because the constraint ratios of exhaust members for actual automobile engines are about 0.1-0.5 permitting elongation to some extent.

With a thermal fatigue life of 800 cycles or more under the conditions of a heating temperature upper limit of 1000° C., a temperature amplitude of 850° C. or more, and a constraint ratio of 0.25, the heat-resistant, austenitic cast steel has excellent thermal fatigue life, suitable for exhaust members exposed to an exhaust gas at as high temperatures as 1000° C. or higher. Exhaust members made of the heat-resistant, austenitic cast steel of the present invention have excellent heat resistance and durability and long lives to thermal fatigue failure in an environment exposed to an exhaust gas at 1000° C. or higher. The heat-resistant, austenitic cast steel of the present invention has a thermal fatigue life of more preferably 850 cycles or more, most preferably 900 cycles or more when measured by a thermal fatigue test under the same conditions as above.

[3] Exhaust Members

The exhaust member of the present invention is produced by the above 20Cr-10Ni, heat-resistant, austenitic cast steel of the present invention. Preferred examples of the exhaust member include exhaust manifolds, turbine housings, integrally cast turbine housings/exhaust manifolds, catalyst cases, integrally cast catalyst cases/exhaust manifolds, and exhaust outlets, though not restrictive. They also include cast members welded to plate or pipe metal members. Any cast exhaust members made of the heat-resistant, austenitic cast steel of the present invention are included.

The exhaust members of the present invention exhibit excellent heat resistance and durability such as high oxidation resistance, thermal fatigue life, etc., even when they are exposed to an exhaust gas at as high temperatures as 1000° C. or higher such that their surface temperatures reach about 950-1000° C. Further, because of excellent weldability, cracking does not occur in welding between plate or pipe metal members and cast members or between cast members, or in the repair of casting defects by welding. In addition, they are economically advantageous because they can be produced inexpensively because of reduced amounts of rare metals used. In sum, because the exhaust members of the present invention having high heat resistance and durability required for exhaust parts are suitable for light-weight or compact parts, etc., and easily usable for popular cars, they are expected to improve the exhaust gas cleaning, fuel efficiency and safety of cars.

The present invention will be explained in more detail referring to Examples below without intention of restricting it thereto. Unless otherwise mentioned, the amount of each element forming the alloy is expressed by "% by mass."

EXAMPLES 1-28 AND COMPARATIVE EXAMPLES 1-22

The chemical compositions of the heat-resistant cast steel samples of Examples 1-28 and Comparative Examples 1-22 are shown in Tables 1 and 2. Tables 1 and 2 show the values of the formulae (1) to (4) defined by the present invention. Specifically, the value of the formula (1) is the value of (C—Nb/8), the value of the formula (2) is the value of [17.5Si−(W+2Mo)], the value of the formula (3) is the value of [5.6Si+(W+2Mo)], and the value of the formula (4) is the value of [0.08Si+(C—Nb/8)+0.015Cr+0.011Ni+0.03W+0.02Mo], wherein the symbol of each element corresponds to the amount (% by mass) of each element in the cast steel.

The heat-resistant, austenitic cast steels of Examples 1-28 are within the composition range of the present invention. In the cast steels of Comparative Examples 1, 2 and 8-17, the amounts of any one or more elements among C, Ni, Mn, Cr, W, Mo, (W+2Mo) and Nb are outside the composition range of the present invention. The cast steels of Comparative Examples 2 and 16 have too large values of the formula (4). The cast steels of Comparative Examples 3-5 have too small values of the formula (2). Among them, the cast steel of Comparative Example 4 contains a too small amount of Si, and the cast steel of Comparative Example 5 is one example of the 20Cr-10Ni, heat-resistant, austenitic cast steels described in JP 7-228948 A. The cast steels of Comparative Examples 6 and 7 have too large values of the formula (3). Among them, the cast steel of Comparative Example 7 contains a too large amount of Si. The cast steels of Comparative Examples 18-21 have too large values of the formula (4). The cast steel of Comparative Example 22 is one example of the 25Cr-20Ni, heat-resistant, high-Cr, high-Ni, austenitic cast steels described in JP 2000-291430 A.

Each cast steel of Examples 1-28 and Comparative Examples 1-22 was melted in a 100-kg, high-frequency furnace with a basic lining in the air, taken out of the furnace at 1550-1600° C., and immediately poured at 1500-1550° C. into a first casting mold to produce a JIS Y-block No. B sample, and a second casting mold to produce a cylindrical sample for evaluating weldability. Each sample was subjected to the following evaluation tests.

TABLE 1

| | Amount (% by mass) | | | | | |
|---|---|---|---|---|---|---|
| No. | C | Si | Mn | S | Cr | Ni |
| Example 1 | 0.30 | 1.10 | 1.0 | 0.14 | 17.5 | 8.0 |
| Example 2 | 0.30 | 1.15 | 1.0 | 0.01 | 17.8 | 8.1 |
| Example 3 | 0.31 | 1.20 | 1.1 | 0.16 | 18.0 | 8.5 |
| Example 4 | 0.32 | 1.25 | 1.1 | 0.15 | 21.5 | 10.5 |
| Example 5 | 0.32 | 1.22 | 1.0 | 0.10 | 17.6 | 8.2 |

TABLE 1-continued

| | | | | | | |
|---|---|---|---|---|---|---|
| Example 6 | 0.32 | 1.45 | 1.0 | 0.15 | 19.2 | 9.1 |
| Example 7 | 0.40 | 1.30 | 1.0 | 0.12 | 20.7 | 9.0 |
| Example 8 | 0.42 | 1.35 | 1.0 | 0.13 | 19.5 | 9.5 |
| Example 9 | 0.44 | 1.21 | 1.0 | 0.14 | 19.8 | 10.0 |
| Example 10 | 0.45 | 1.28 | 1.2 | 0.15 | 20.0 | 9.9 |
| Example 11 | 0.45 | 1.26 | 1.2 | 0.15 | 21.2 | 9.9 |
| Example 12 | 0.44 | 1.45 | 1.1 | 0.14 | 19.9 | 9.8 |
| Example 13 | 0.43 | 1.56 | 1.0 | 0.16 | 19.8 | 9.7 |
| Example 14 | 0.45 | 1.50 | 1.0 | 0.17 | 20.2 | 10.1 |
| Example 15 | 0.45 | 1.45 | 1.0 | 0.15 | 20.3 | 10.2 |
| Example 16 | 0.46 | 1.59 | 1.0 | 0.18 | 20.1 | 9.9 |
| Example 17 | 0.48 | 1.60 | 1.0 | 0.17 | 20.0 | 10.1 |
| Example 18 | 0.45 | 1.58 | 1.0 | 0.18 | 22.5 | 12.0 |
| Example 19 | 0.46 | 1.75 | 1.0 | 0.19 | 19.9 | 10.2 |
| Example 20 | 0.45 | 1.77 | 1.0 | 0.20 | 22.4 | 13.0 |
| Example 21 | 0.45 | 1.90 | 1.2 | 0.15 | 20.0 | 10.0 |
| Example 22 | 0.50 | 1.20 | 1.0 | 0.16 | 20.2 | 9.8 |
| Example 23 | 0.55 | 1.31 | 1.0 | 0.17 | 20.1 | 9.2 |
| Example 24 | 0.54 | 1.42 | 1.0 | 0.30 | 19.8 | 9.9 |
| Example 25 | 0.54 | 1.61 | 1.0 | 0.40 | 19.9 | 10.0 |
| Example 26 | 0.55 | 1.79 | 1.5 | 0.50 | 19.8 | 10.1 |
| Example 27 | 0.57 | 1.80 | 1.1 | 0.16 | 20.2 | 9.8 |
| Example 28 | 0.60 | 2.00 | 1.0 | 0.15 | 20.3 | 10.1 |

| | Amount (% by mass) | | | | |
|---|---|---|---|---|---|
| No. | W | Mo | W + 2Mo | Nb | N |
| Example 1 | 1.8 | — | 1.8 | 1.0 | 0.08 |
| Example 2 | 2.6 | — | 2.6 | 2.0 | 0.09 |
| Example 3 | 3.5 | — | 3.5 | 1.1 | 0.09 |
| Example 4 | 3.3 | — | 3.3 | 1.2 | 0.11 |
| Example 5 | 1.5 | — | 1.5 | 1.2 | 0.01 |
| Example 6 | 2.8 | — | 2.8 | 1.2 | 0.12 |
| Example 7 | 2.6 | — | 2.6 | 1.1 | 0.07 |
| Example 8 | 3.1 | — | 3.1 | 1.5 | 0.09 |
| Example 9 | 1.8 | — | 1.8 | 1.9 | 0.09 |
| Example 10 | 3.8 | — | 3.8 | 2.0 | 0.10 |
| Example 11 | 2.7 | — | 2.7 | 2.0 | 0.10 |
| Example 12 | — | 0.81 | 1.6 | 1.9 | 0.09 |
| Example 13 | — | 1.98 | 4.0 | 1.6 | 0.11 |
| Example 14 | 2.1 | 0.92 | 3.9 | 1.8 | 0.10 |
| Example 15 | 3.0 | — | 3.0 | 2.1 | 0.10 |
| Example 16 | 3.1 | — | 3.1 | 2.0 | 0.09 |
| Example 17 | 4.0 | — | 4.0 | 2.1 | 0.11 |
| Example 18 | 3.5 | — | 3.5 | 1.7 | 0.12 |
| Example 19 | 2.9 | — | 2.9 | 1.9 | 0.10 |
| Example 20 | 3.4 | — | 3.4 | 1.8 | 0.11 |
| Example 21 | 2.7 | — | 2.7 | 2.0 | 0.09 |
| Example 22 | 3.0 | — | 3.0 | 2.1 | 0.16 |
| Example 23 | 2.7 | — | 2.7 | 2.2 | 0.08 |
| Example 24 | 2.9 | — | 2.9 | 2.0 | 0.11 |
| Example 25 | 3.8 | — | 3.8 | 3.8 | 0.09 |
| Example 26 | 2.0 | — | 2.0 | 2.0 | 0.30 |
| Example 27 | 3.6 | — | 3.6 | 2.5 | 0.12 |
| Example 28 | 2.5 | — | 2.5 | 2.3 | 0.15 |

| | Amount (% by mass) | | | | |
|---|---|---|---|---|---|
| No. | Value of Formula (1) | Value of Formula (2) | Value of Formula (3) | Value of Formula (4) | Fe |
| Example 1 | 0.18 | 17.5 | 8.0 | 0.67 | Bal. |
| Example 2 | 0.05 | 17.5 | 9.0 | 0.58 | Bal. |
| Example 3 | 0.17 | 17.5 | 10.2 | 0.74 | Bal. |
| Example 4 | 0.17 | 18.6 | 10.3 | 0.81 | Bal. |
| Example 5 | 0.17 | 19.9 | 8.3 | 0.67 | Bal. |
| Example 6 | 0.17 | 22.6 | 10.9 | 0.76 | Bal. |
| Example 7 | 0.26 | 20.2 | 9.9 | 0.85 | Bal. |
| Example 8 | 0.23 | 20.5 | 10.7 | 0.83 | Bal. |
| Example 9 | 0.20 | 19.4 | 8.6 | 0.76 | Bal. |
| Example 10 | 0.20 | 18.6 | 11.0 | 0.83 | Bal. |
| Example 11 | 0.20 | 19.4 | 9.8 | 0.81 | Bal. |
| Example 12 | 0.20 | 23.8 | 9.7 | 0.74 | Bal. |
| Example 13 | 0.23 | 23.3 | 12.7 | 0.80 | Bal. |
| Example 14 | 0.23 | 22.3 | 12.3 | 0.84 | Bal. |
| Example 15 | 0.19 | 22.4 | 11.1 | 0.81 | Bal. |

TABLE 1-continued

| | | | | | |
|---|---|---|---|---|---|
| Example 16 | 0.21 | 24.7 | 12.0 | 0.84 | Bal. |
| Example 17 | 0.22 | 24.0 | 13.0 | 0.88 | Bal. |
| Example 18 | 0.24 | 24.2 | 12.3 | 0.94 | Bal. |
| Example 19 | 0.22 | 27.7 | 12.7 | 0.86 | Bal. |
| Example 20 | 0.23 | 27.6 | 13.3 | 0.95 | Bal. |
| Example 21 | 0.20 | 30.6 | 13.3 | 0.84 | Bal. |
| Example 22 | 0.24 | 18.0 | 9.7 | 0.83 | Bal. |
| Example 23 | 0.28 | 20.2 | 10.0 | 0.86 | Bal. |
| Example 24 | 0.29 | 22.0 | 10.9 | 0.90 | Bal. |
| Example 25 | 0.07 | 24.4 | 12.8 | 0.72 | Bal. |
| Example 26 | 0.30 | 29.3 | 12.0 | 0.91 | Bal. |
| Example 27 | 0.26 | 27.9 | 13.7 | 0.92 | Bal. |
| Example 28 | 0.31 | 32.5 | 13.7 | 0.96 | Bal. |

The value of the formula (1): (C − Nb/8).

The value of the formula (2): 17.5Si − (W + 2Mo).

The value of the formula (3): 5.6Si + (W + 2Mo).

The value of the formula (4): 0.08Si + (C − Nb/8) + 0.015Cr + 0.011Ni + 0.03W + 0.02Mo.

TABLE 2

| | Amount (% by mass) | | | | | |
|---|---|---|---|---|---|---|
| No. | C | Si | Mn | S | Cr | Ni |
| Com. Ex. 1 | 0.20 | 1.45 | 1.0 | 0.15 | 20.5 | 10.6 |
| Com. Ex. 2 | 0.70 | 1.45 | 1.0 | 0.15 | 20.1 | 10.0 |
| Com. Ex. 3 | 0.31 | 1.10 | 1.2 | 0.16 | 17.7 | 8.2 |
| Com. Ex. 4 | 0.45 | 0.90 | 1.1 | 0.15 | 21.2 | 9.8 |
| Com. Ex. 5 | 0.33 | 1.15 | 1.0 | 0.14 | 18.5 | 8.6 |
| Com. Ex. 6 | 0.57 | 1.91 | 1.0 | 0.16 | 20.5 | 10.1 |
| Com. Ex. 7 | 0.45 | 2.15 | 1.0 | 0.15 | 20.2 | 9.9 |
| Com. Ex. 8 | 0.45 | 1.45 | 1.1 | 0.15 | 19.9 | 7.0 |
| Com. Ex. 9 | 0.45 | 1.45 | 1.8 | 0.15 | 19.9 | 10.0 |
| Com. Ex. 10 | 0.44 | 1.44 | 1.0 | 0.14 | 16.5 | 10.2 |
| Com. Ex. 11 | 0.44 | 1.44 | 1.1 | 0.14 | 23.5 | 10.2 |
| Com. Ex. 12 | 0.45 | 1.45 | 1.1 | 0.15 | 20.0 | 9.9 |
| Com. Ex. 13 | 0.45 | 1.45 | 1.2 | 0.15 | 20.0 | 9.9 |
| Com. Ex. 14 | 0.46 | 1.44 | 1.0 | 0.13 | 19.8 | 9.8 |
| Com. Ex. 15 | 0.46 | 1.45 | 1.0 | 0.13 | 19.8 | 9.8 |
| Com. Ex. 16 | 0.46 | 1.45 | 1.1 | 0.13 | 20.6 | 10.5 |
| Com. Ex. 17 | 0.46 | 1.45 | 1.1 | 0.12 | 20.6 | 10.5 |
| Com. Ex. 18 | 0.45 | 1.30 | 1.0 | 0.15 | 22.3 | 12.8 |
| Com. Ex. 19 | 0.45 | 1.70 | 0.9 | 0.15 | 22.3 | 12.8 |
| Com. Ex. 20 | 0.53 | 1.30 | 1.1 | 0.14 | 20.0 | 10.0 |
| Com. Ex. 21 | 0.55 | 1.75 | 1.0 | 0.16 | 18.0 | 8.5 |
| Com. Ex. 22 | 0.45 | 0.95 | 1.0 | 0.15 | 25.0 | 21.0 |

| | Amount (% by mass) | | | | |
|---|---|---|---|---|---|
| No. | W | Mo | W + 2Mo | Nb | N |
| Com. Ex. 1 | 3.2 | — | 3.2 | 1.2 | 0.09 |
| Com. Ex. 2 | 3.0 | — | 3.0 | 2.0 | 0.12 |
| Com. Ex. 3 | 2.5 | — | 2.5 | 1.5 | 0.08 |
| Com. Ex. 4 | 3.0 | — | 3.0 | 1.9 | 0.10 |
| Com. Ex. 5 | 3.8 | — | 3.8 | 1.4 | 0.09 |
| Com. Ex. 6 | 3.3 | — | 3.3 | 2.4 | 0.09 |
| Com. Ex. 7 | 3.1 | — | 3.1 | 2.1 | 0.10 |
| Com. Ex. 8 | 3.0 | — | 3.0 | 2.0 | 0.10 |
| Com. Ex. 9 | 3.0 | — | 3.0 | 2.0 | 0.10 |
| Com. Ex. 10 | 2.9 | — | 2.9 | 1.9 | 0.09 |
| Com. Ex. 11 | 2.9 | — | 2.9 | 1.9 | 0.09 |
| Com. Ex. 12 | 1.0 | — | 1.0 | 2.0 | 0.10 |
| Com. Ex. 13 | 5.0 | — | 5.0 | 2.0 | 0.10 |
| Com. Ex. 14 | — | 0.65 | 1.3 | 1.8 | 0.10 |
| Com. Ex. 15 | — | 2.20 | 4.4 | 1.8 | 0.09 |
| Com. Ex. 16 | 3.1 | — | 3.1 | 0.9 | 0.08 |
| Com. Ex. 17 | 3.1 | — | 3.1 | 4.5 | 0.08 |
| Com. Ex. 18 | 3.0 | — | 3.0 | 1.0 | 0.10 |
| Com. Ex. 19 | 3.0 | — | 3.0 | 1.4 | 0.09 |
| Com. Ex. 20 | 3.0 | — | 3.0 | 1.0 | 0.09 |
| Com. Ex. 21 | 3.8 | — | 3.8 | 1.5 | 0.11 |
| Com. Ex. 22 | 3.0 | — | 3.0 | 1.8 | 0.08 |

TABLE 2-continued

| No. | Amount (% by mass) | | | | |
|---|---|---|---|---|---|
| | Value of Formula (1) | Value of Formula (2) | Value of Formula (3) | Value of Formula (4) | Fe |
| Com. Ex. 1 | 0.05 | 22.2 | 11.3 | 0.69 | Bal. |
| Com. Ex. 2 | 0.45 | 22.4 | 11.1 | 1.07 | Bal. |
| Com. Ex. 3 | 0.12 | 16.8 | 8.7 | 0.64 | Bal. |
| Com. Ex. 4 | 0.21 | 12.8 | 8.0 | 0.80 | Bal. |
| Com. Ex. 5 | 0.16 | 16.3 | 10.2 | 0.73 | Bal. |
| Com. Ex. 6 | 0.27 | 30.1 | 14.0 | 0.94 | Bal. |
| Com. Ex. 7 | 0.19 | 34.5 | 15.1 | 0.86 | Bal. |
| Com. Ex. 8 | 0.20 | 22.4 | 11.1 | 0.78 | Bal. |
| Com. Ex. 9 | 0.20 | 22.4 | 11.1 | 0.81 | Bal. |
| Com. Ex. 10 | 0.20 | 22.3 | 11.0 | 0.76 | Bal. |
| Com. Ex. 11 | 0.20 | 22.3 | 11.0 | 0.87 | Bal. |
| Com. Ex. 12 | 0.20 | 24.4 | 9.1 | 0.75 | Bal. |
| Com. Ex. 13 | 0.20 | 20.4 | 13.1 | 0.87 | Bal. |
| Com. Ex. 14 | 0.24 | 23.9 | 9.4 | 0.77 | Bal. |
| Com. Ex. 15 | 0.24 | 21.0 | 12.5 | 0.80 | Bal. |
| Com. Ex. 16 | 0.35 | 22.3 | 11.2 | 0.98 | Bal. |
| Com. Ex. 17 | −0.10 | 22.3 | 11.2 | 0.53 | Bal. |
| Com. Ex. 18 | 0.33 | 19.8 | 10.3 | 0.99 | Bal. |
| Com. Ex. 19 | 0.28 | 26.8 | 12.5 | 0.98 | Bal. |
| Com. Ex. 20 | 0.41 | 19.8 | 10.3 | 1.01 | Bal. |
| Com. Ex. 21 | 0.36 | 26.8 | 13.6 | 0.98 | Bal. |
| Com. Ex. 22 | 0.23 | 13.6 | 8.3 | 1.00 | Bal. |

The value of the formula (1): (C − Nb/8).
The value of the formula (2): 17.5Si − (W + 2Mo).
The value of the formula (3): 5.6Si + (W + 2Mo).
The value of the formula (4): 0.08Si + (C − Nb/8) + 0.015Cr + 0.011Ni + 0.03W + 0.02Mo.

(1) High-temperature Yield Strength

Each sample was evaluated with respect to 0.2-% yield strength (MPa) at 1000° C. as an indicator of the high-temperature strength of exhaust members. A flanged, smooth, round rod test piece of 50 mm in gauge length and 10 mm in diameter was cut out of each sample, and attached to an electric-hydraulic servo material test machine (Servopulser EHF-ED10T-20L available from Shimadzu Corporation) to measure 0.2-% yield strength (MPa) as high-temperature yield strength at 1000° C. in the air. The evaluation results are shown in Tables 3 and 4. As is clear from Tables 3 and 4, the test pieces of Examples 1-28 within the present invention had high-temperature yield strength of 50 MPa or more, and particularly when the amount of C was 0.40% or more, the high-temperature yield strength was stably 60 MPa or more, indicating that increase in the amount of C contributes to the improvement of the high-temperature strength.

(2) Weight Loss by Oxidation

In view of the fact that exhaust members are exposed to an exhaust gas at nearly 1000° C., their oxidation resistance at 1000° C. was evaluated by keeping a round rod test piece of 10 mm in diameter and 20 mm in length cut out of each sample in the air at 1000° C. for 200 hours, removing oxide scales from the taken-out test piece by shot blasting, and determining mass change per a unit area [weight loss by oxidation (mg/cm$^2$)] before and after the oxidation test. The evaluation results are shown in Tables 3 and 4.

As is clear from Tables 3 and 4, any heat-resistant, austenitic cast steels of Examples 1-28 had as small weight loss by oxidation as 20 mg/cm$^2$ or less within the preferred range of the present invention, despite small amounts of Cr and Ni, indicating that they had oxidation resistance on the same level as that of the 25Cr-20Ni, heat-resistant, high-Cr, high-Ni, austenitic cast steel of Comparative Example 22. On the other hand, all of Comparative Example 4 containing a small amount of Si, Comparative Example 9 containing a large amount of Mn, Comparative Example 10 containing a small amount of Cr, Comparative Example 13 containing a large amount of W, Comparative Example 15 containing a large amount of Mo, and Comparative Example 16 containing a small amount of Nb suffered as much weight loss by oxidation as more than 20 mg/cm$^2$. These results confirm that the heat-resistant cast steels of the present invention have sufficient oxidation resistance for exhaust members exposed to an exhaust gas at 1000° C. or higher, despite the fact that they are 20Cr-10Ni alloys.

(3) Thermal Fatigue Life

The thermal fatigue life of each sample was evaluated by attaching a smooth, round rod test piece of 25 mm in gauge length and 10 mm in diameter cut out of each sample to the same electric-hydraulic servo material test machine as in the high-temperature yield strength test at a constraint ratio of 0.25, repeating heating/cooling cycles to each test piece in the air, each cycle having temperature elevation for 2 minutes, keeping the temperature for 1 minute, and cooling for 4 minutes, 7 minutes in total, under the conditions that the lower limit of cooling temperature was 150° C., that the upper limit of heating temperature was 1000° C., and that the temperature amplitude was 850° C. Using the maximum tensile load in a load-temperature diagram at the second cycle as a reference (100%), the number of heating/cooling cycles when the maximum tensile load decreased to 75% was counted as a thermal fatigue life. The evaluation results are shown in Tables 3 and 4.

As is clear from Tables 3 and 4, all of Examples 1-28 had as long thermal fatigue lives as 800 cycles or more, despite small amounts of Cr and Ni, indicating that they had thermal fatigue lives on the same level as that of the 25Cr-20Ni, heat-resistant, high-Cr, high-Ni, austenitic cast steel of Comparative Example 22. On the other hand, Comparative Example 1 containing a small amount of C, Comparative Examples 3-5 having too small values of the formula (2), Comparative Examples 6 and 7 having too large values of the formula (3), Comparative Example 8 containing a small amount of Ni, and Comparative Examples 10-17, in which the amounts of any one or more of Cr, W, Mo, (W+2Mo), Nb were outside the composition ranges the present invention, had as short thermal fatigue lives as less than 800 cycles. Particularly, Comparative Example 5 corresponding to the conventional 20Cr-10Ni, heat-resistant, austenitic cast steel had a thermal fatigue life of less than 800 cycles, because its value of the formula (2) was less than 17.5, the lower limit of the present invention. These results confirm that the heat-resistant cast steels of the present invention have sufficient thermal fatigue lives for exhaust members exposed to an exhaust gas at 1000° C. or higher, despite the fact that they are 20Cr-10Ni alloys.

Figure 2:
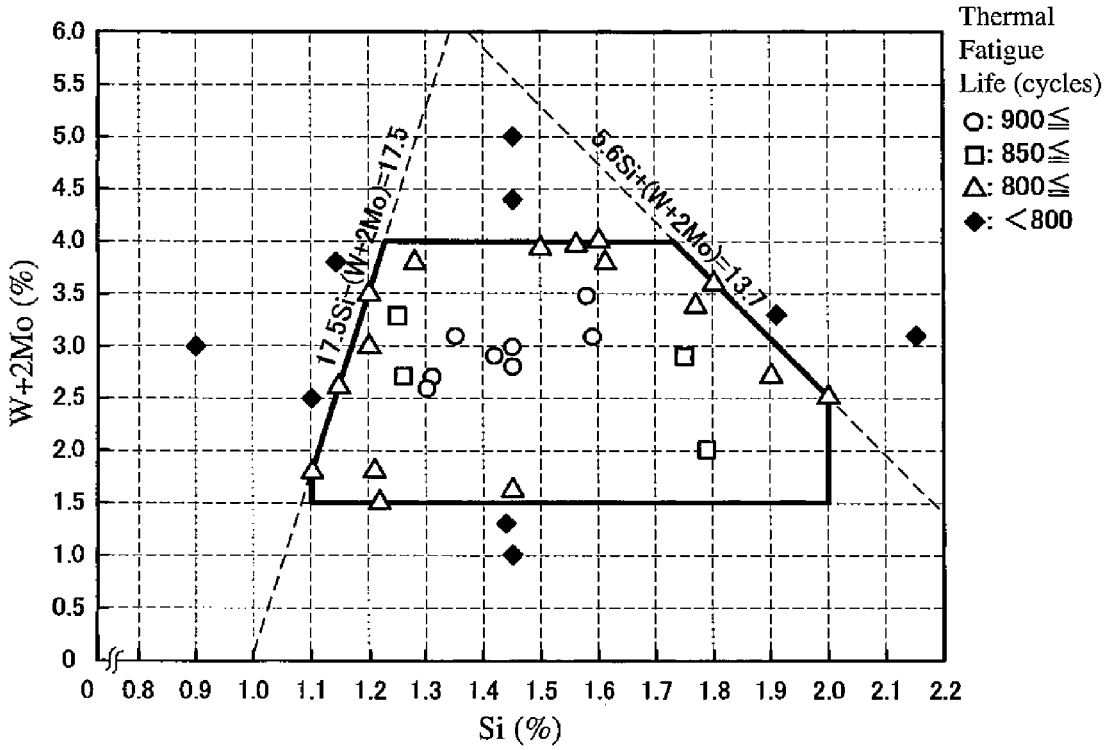
FIG. 2 is a graph showing the relation between the amounts of Si and (W+2Mo) and the thermal fatigue life of heat-resistant, austenitic cast steel.

FIG. 2 shows the relation between the amounts of Si and (W+2Mo) and the thermal fatigue life of the heat-resistant, austenitic cast steel. Plotted in FIG. 2 are Examples 1-28, and Comparative Examples 3-7 and 12-15 in which other compositions than Si, W, Mo and (W+2Mo), and the values of other formulae than the formulae (2) and (3) are within the ranges of the present invention. The shapes of symbols indicate various thermal fatigue lives (the number of cycles); black rhombi for those less than 800, triangles for those of 800 or more and less than 850, squares for those of 850 or more and less than 900, and circles for those of 900 or more. Thick, solid lines show boundaries of a region defined by Si=1.1 to 2, (W+2Mo)=1.5 to 4, the formula (2) of $17.5 \leqq 17.5Si-(W+2Mo)$, and the formula (3) of $5.6Si+(W+2Mo) \leqq 13.7$ in the present invention, the region defined by these thick, solid lines meeting the composition requirements of Si and (W+2Mo) in the present invention. It is clear from FIG. 2 that the heat-resistant, austenitic cast steel of the present invention has a thermal fatigue life of 800 cycles or more, as long as Si and (W+2Mo) are within this region. This means that the heat-resistant, austenitic cast steel should have composition ranges not simply based on the amount of each of Si and W and/or Mo, but based on the relation of Si and (W+2Mo) for providing excellent thermal fatigue life.

TABLE 3

| No. | High-Temp. Yield Strength (MPa) | Weight Loss By Oxidation ($mg/cm^2$) | Thermal Fatigue Life (cycles) | Solidification Temperature Range $\Delta T_{0.7}$ (° C.) | Weldability |
|---|---|---|---|---|---|
| Example 1 | 58 | 20 | 805 | 64 | Not Cracked |
| Example 2 | 55 | 17 | 801 | 51 | Not Cracked |
| Example 3 | 56 | 18 | 802 | 63 | Not Cracked |
| Example 4 | 63 | 14 | 862 | 65 | Not Cracked |
| Example 5 | 54 | 16 | 804 | 55 | Not Cracked |
| Example 6 | 60 | 10 | 940 | 62 | Not Cracked |
| Example 7 | 65 | 10 | 953 | 57 | Not Cracked |
| Example 8 | 68 | 9 | 964 | 59 | Not Cracked |
| Example 9 | 62 | 15 | 815 | 65 | Not Cracked |
| Example 10 | 64 | 12 | 824 | 64 | Not Cracked |
| Example 11 | 65 | 13 | 863 | 64 | Not Cracked |
| Example 12 | 60 | 10 | 826 | 57 | Not Cracked |
| Example 13 | 61 | 9 | 821 | 57 | Not Cracked |
| Example 14 | 62 | 10 | 844 | 63 | Not Cracked |
| Example 15 | 69 | 10 | 992 | 52 | Not Cracked |
| Example 16 | 68 | 9 | 975 | 58 | Not Cracked |
| Example 17 | 66 | 9 | 813 | 61 | Not Cracked |
| Example 18 | 67 | 9 | 979 | 66 | Not Cracked |
| Example 19 | 68 | 9 | 862 | 64 | Not Cracked |
| Example 20 | 65 | 8 | 830 | 63 | Not Cracked |
| Example 21 | 63 | 9 | 839 | 54 | Not Cracked |
| Example 22 | 61 | 17 | 818 | 63 | Not Cracked |
| Example 23 | 69 | 10 | 958 | 65 | Not Cracked |
| Example 24 | 68 | 9 | 977 | 67 | Not Cracked |
| Example 25 | 65 | 9 | 847 | 63 | Not Cracked |
| Example 26 | 66 | 8 | 853 | 62 | Not Cracked |
| Example 27 | 64 | 8 | 808 | 56 | Not Cracked |
| Example 28 | 62 | 7 | 811 | 65 | Not Cracked |

TABLE 4

| No. | High-Temp. Yield Strength (MPa) | Weight Loss By Oxidation ($mg/cm^2$) | Thermal Fatigue Life (cycles) | Solidification Temperature Range $\Delta T_{0.7}$ (° C.) | Weldability |
|---|---|---|---|---|---|
| Com. Ex. 1 | 50 | 13 | 556 | 68 | Not Cracked |
| Com. Ex. 2 | 65 | 16 | 800 | 75 | Cracked |
| Com. Ex. 3 | 59 | 19 | 783 | 64 | Not Cracked |
| Com. Ex. 4 | 61 | 27 | 723 | 63 | Not Cracked |
| Com. Ex. 5 | 63 | 18 | 788 | 61 | Not Cracked |
| Com. Ex. 6 | 56 | 8 | 791 | 56 | Not Cracked |
| Com. Ex. 7 | 61 | 5 | 607 | 66 | Cracked |
| Com. Ex. 8 | 55 | 11 | 503 | 65 | Not Cracked |
| Com. Ex. 9 | 66 | 31 | 888 | 62 | Not Cracked |
| Com. Ex. 10 | 54 | 22 | 651 | 64 | Not Cracked |
| Com. Ex. 11 | 58 | 8 | 729 | 63 | Not Cracked |
| Com. Ex. 12 | 53 | 11 | 633 | 60 | Not Cracked |
| Com. Ex. 13 | 54 | 21 | 592 | 59 | Not Cracked |
| Com. Ex. 14 | 53 | 11 | 754 | 63 | Not Cracked |
| Com. Ex. 15 | 66 | 20 | 788 | 57 | Not Cracked |

TABLE 4-continued

| No. | High-Temp. Yield Strength (MPa) | Weight Loss By Oxidation ($mg/cm^2$) | Thermal Fatigue Life (cycles) | Solidification Temperature Range $\Delta T_{0.7}$ (° C.) | Weldability |
|---|---|---|---|---|---|
| Com. Ex. 16 | 57 | 24 | 793 | 73 | Cracked |
| Com. Ex. 17 | 52 | 8 | 536 | 60 | Not Cracked |
| Com. Ex. 18 | 69 | 8 | 903 | 81 | Cracked |
| Com. Ex. 19 | 67 | 5 | 915 | 78 | Cracked |
| Com. Ex. 20 | 63 | 10 | 802 | 84 | Cracked |
| Com. Ex. 21 | 59 | 8 | 817 | 77 | Cracked |
| Com. Ex. 22 | 62 | 11 | 810 | 78 | Cracked |

(4) Weldability

The weldability was evaluated by producing a pair of cylindrical test pieces of 50 mm in outer diameter and 5 mm in thickness each having an I-shaped groove for welding from each sample, abutting them under the following welding conditions to conduct butt-welding, and cutting them in 7 portions except for a welding-starting portion and a welding-ending portion to observe whether or not there were cracks. Tables 3 and 4 show the evaluation results of weldability.

Welding conditions

Welding method: pulsed MIG welding,

Wire: Solid wire of JIS Z 3321 Y310 having a diameter of 1.2 mm,

Average current: 200 A,

Voltage: 20 V,

Feed speed: 110 cm/min,

Distance between nozzle and work: 10 mm,

Type of shield gas: Ar-2% $O_2$,

Flow rate of shield gas: 15 L/min,

Torch angle: 10° (progressive welding), and

Preheating: Non.

Exhaust members should have such high weldability as to avoid cracking in welding between plate or pipe metal members and cast members or between cast members themselves, or in welding repair of casting defects in cast members. As is clear from Tables 3 and 4, there was no weld cracking in Examples 1-28. However, Comparative Example 2 containing a too large amount of C and having a too large value of the formula (4), Comparative Example 7 containing a too large amount of Si, Comparative Examples 16 and 18-22 having too large values of the formula (4) suffered weld cracking. With respect to cracking, Comparative Example 7 containing a too large amount of Si had cracking in the base material, and other Comparative Examples 2, 16 and 18-22 had cracking in beads. These results confirm that the heat-resistant cast steels of the present invention have weldability necessary for exhaust members.

(5) Solidification Temperature Range $\Delta T_{0.7}$

The solidification temperature range $\Delta T_{0.7}$ was determined from a thermal analysis curve obtained by heating a test piece of 2 mm in diameter and 2 mm in length cut out of each sample at a temperature elevation speed of 15° C./minute up to 900° C., and 5° C./minute between 900° C. and 1600° C., in an argon atmosphere by a differential scanning calorimeter (DSC, available from SETARAM), by image analysis described below using an image analyzer (IP1000 available from Asahi Kasei Corporation). Namely, as described above referring to FIG. 1, a hatched area in FIG. 1 was determined as a total area (100%) from the relation between temperature and heat flow in a solidification temperature range $\Delta T$ from the solidification start to the completion of solidification, and the area of heat flow was accumulated by a unit temperature from the solidification start to determine a temperature at which the accumulated area reached 70% of the total area as the solidification temperature range $\Delta T_{0.7}$. The determined solidification temperature ranges $\Delta T_{0.7}$ (° C.) are shown in Tables 3 and 4.

As is clear from Tables 3 and 4, no weld cracking was observed in Examples 1-28, in which the value of the formula (4) was 0.96 or less, and the solidification temperature range $\Delta T_{0.7}$ was 70° C. or lower. However, weld cracking was observed in Comparative Examples 2, 16 and 18-22, in which the value of the formula (4) was more than 0.96, and the solidification temperature range $\Delta T_{0.7}$ was more than 70° C. These results confirmed that the heat-resistant cast steel of the present invention having a solidification temperature range $\Delta T_{0.7}$ of 70° C. or less had good weldability. Comparative Example 7 suffered weld cracking, despite the fact that the value of the formula (4) was 0.96 or less, and that the solidification temperature range $\Delta T_{0.7}$ was 70° C. or less. Because cracking occurred not in the bead but in the base material, it is presumed that in the cast steel of Comparative Example 7 containing excess Si, low-melting-point Si concentrated in crystal grain boundaries of the base material was locally melted during welding, causing cracking.

EXAMPLE 29

The heat-resistant, austenitic cast steel of Example 15 was cast to form an exhaust manifold having a main thickness of 4.0-5.0 mm, an exhaust member for automobiles, and machined in an as-cast state. The exhaust manifold suffered neither casting defects such as shrinkage cavities, misrun, gas defects, etc., nor machining trouble, the abnormal wear and damage of cutting tools, etc.

The exhaust manifold of this Example was assembled to an exhaust simulator corresponding to a high-performance, inline, four-cylinder, gasoline engine with displacement of 2000 cc, to conduct a durability test for measuring a life until penetrating cracks were generated, and how cracks and oxidation occurred. In the durability test, a cycle consisting of 10 minutes of heating and 10 minutes of cooling was repeated under the conditions that the exhaust gas temperature under full load was about 1050° C. at an outlet of a converging portion of the exhaust manifold, a downstream side of the exhaust gas, that the upper limit of a heating temperature at a surface of the converging portion of the exhaust manifold was about 1000° C., and that the lower limit of a cooling temperature was about 90° C. in the converging portion (temperature amplitude=about 910° C.). The targeted number of heating/cooling cycles was 1500 cycles.

The durability test revealed that the exhaust manifold of this Example achieved 1500 cycles without suffering the leakage of an exhaust gas and cracking. Detailed observation after the durability test by appearance inspection and penetrant inspection revealed that though extremely small cracks were observed in part of branch pipes in the penetrant inspection, the exhaust manifold suffered neither penetrating cracks nor cracks observed by appearance inspection, with little oxidation on the entire surface. This confirmed that the exhaust manifold of this Example had excellent heat resistance and durability.

COMPARATIVE EXAMPLE 23

Using the cast steel of Comparative Example 5, an exhaust manifold was produced with the same shape and conditions as in Example 29, without suffering casting defects and machining trouble. The exhaust manifold was assembled to the exhaust simulator to conduct a durability test with 1500 cycles as a target under the same conditions as in Example 29. The converging portion of the exhaust manifold had substantially the same surface temperature as in Example 29 in the durability test.

The durability test revealed that the exhaust manifold of Comparative Example 23 achieved 1500 cycles without suffering the leakage of an exhaust gas and cracking. Detailed observation after the durability test as in Example 29 revealed that the converging portion had cracks, which did not penetrate the exhaust manifold but was observed by appearance inspection, and that small cracks were observed in the branch pipes by the penetrant inspection. Though there was little oxidation on the entire surface, the oxidation was deeper than in the exhaust manifold of Example 29.

As described above, exhaust members made of the heat-resistant, austenitic cast steel of the present invention had high oxidation resistance and long thermal fatigue life at a temperature of about 1000° C., confirming excellent heat resistance and durability. Because the exhaust members of the present invention are made of the heat-resistant, austenitic cast steel containing small amounts of rare metals and thus enjoying good economic advantages from the aspect of cost and the saving of natural resources, they are suitable for engine parts for automobiles.

Though exhaust members for automobile engines have been explained above, the present invention is not restricted thereto, and the heat-resistant, austenitic cast steel of the present invention can also be used for cast parts required to have excellent heat resistance and durability such as high oxidation resistance and long thermal fatigue life, as well as good weldability, for instance, combustion engines for construction machines, ships, aircrafts, etc., thermal equipments for melting furnaces, heat treatment furnaces, combustion furnaces, kilns, boilers, cogeneration facilities, etc., and various plants such as petrochemical plants, gas plants, thermal power generation plants, nuclear power plants, etc.

EFFECT OF THE INVENTION

Because the heat-resistant, austenitic cast steel of the present invention has excellent weldability in addition to heat resistance such as oxidation resistance and thermal fatigue life at around 1000° C., the heat resistance being given by substituting expensive rare metals such as Cr and Ni, etc. with relatively inexpensive Si, it has economic advantages in a low cost of raw materials, and contributes to effective use and stable supply of rare metal resources. The heat-resistant, austenitic cast steel of the present invention is suitable for exhaust members for automobiles.

Exhaust members made of the heat-resistant, austenitic cast steel of the present invention have high heat resistance and durability required for cleaning exhaust gases from automobiles, improving fuel efficiency and safety, as well as excellent weldability, which enables thinning, weight reduction, size reduction, smooth discharge, etc. In addition, because they can be produced inexpensively with reduced amounts of rare metals, they can be suitable for engine parts for popular cars.

What is claimed is:

1. Heat-resistant, austenitic cast steel consisting of, by mass, 0.3-0.6% of C, 1.1-2% of Si, 1.5% or less of Mn, 17.5-22.5% of Cr, 8-13% of Ni, 1.5-4% as (W+2Mo) of at least one of W and Mo, 1-4% of Nb, 0.01-0.3% of N, 0.01-0.5% of S, the balance being Fe and inevitable impurities, and meeting the following formulae (1), (2), (3) and (4):

$$0.05 \leqq (C - Nb/8) \leqq 0.6 \quad (1),$$

$$17.5 \leqq 17.5Si - (W+2Mo) \quad (2),$$

$$5.6Si + (W+2Mo) \leqq 13.7 \quad (3), \text{ and}$$

$$0.08Si + (C - Nb/8) + 0.015Cr + 0.011Ni + 0.03W + 0.02Mo \leqq 0.96 \quad (4),$$

wherein the symbol of each element corresponds to the amount (% by mass) of each element in the cast steel, wherein said cast steel is a 20Cr-10Ni based heat resistant austenitic cast steel, wherein a Cr oxide layer is formed in the outermost layer and a blocky Si oxide phase is formed inside the outermost layer, and wherein said steel has a thermal fatigue life of 800 cycles or more, when measured by a thermal fatigue test comprising heating and cooling under the conditions of a heating temperature upper limit of 1000° C., a temperature amplitude of 850° C. or more, and a constraint ratio of 0.25.

2. The heat-resistant, austenitic cast steel according to claim 1, which has weight loss by oxidation of 15 mg/cm$^2$ or less when kept at 1000° C. for 200 hours in the air.

3. An exhaust member formed by the heat-resistant, austenitic cast steel recited in claim 1.

4. The exhaust member according to claim 3, wherein it is an exhaust manifold, a turbine housing, a turbine housing integral with an exhaust manifold, a catalyst case, a catalyst case integral with an exhaust manifold, or an exhaust outlet.

* * * * *